US006983811B2

(12) United States Patent
Wardley

(10) Patent No.: US 6,983,811 B2
(45) Date of Patent: Jan. 10, 2006

(54) REAMER SHOE

(75) Inventor: Mike Wardley, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/149,096

(22) PCT Filed: Dec. 11, 2000

(86) PCT No.: PCT/GB00/04704

§ 371 (c)(1),
(2), (4) Date: Oct. 29, 2002

(87) PCT Pub. No.: WO01/42617

PCT Pub. Date: Jun. 14, 2001

(65) Prior Publication Data

US 2003/0075364 A1 Apr. 24, 2003

(30) Foreign Application Priority Data

Dec. 9, 1999 (GB) ..... 9929000

(51) Int. Cl.
*E21B 17/14* (2006.01)

(52) U.S. Cl. ..... 175/402

(58) Field of Classification Search ..... 175/406, 175/408, 426, 435, 402, 327, 325.1
See application file for complete search history.

(56) References Cited

U.S. PATENT DOCUMENTS 1,153,311 A * 9/1915 Montgomery ..... 476/16
3,011,556 A 12/1961 Best ..... 166/173
3,268,274 A * 8/1966 Ortloff et al. ..... 175/325.4
4,385,669 A 5/1983 Knutsen
4,467,879 A 8/1984 Burge ..... 175/325
5,390,750 A * 2/1995 Deken et al. ..... 175/406
5,697,442 A * 12/1997 Baldridge ..... 166/286
5,957,223 A * 9/1999 Doster et al. ..... 175/57

FOREIGN PATENT DOCUMENTS

| | | |
|---|---|---|
| GB | 2 166 177 | 4/1986 |
| WO | WO 96/28635 | 9/1996 |
| WO | WO 99/37881 | 7/1999 |

OTHER PUBLICATIONS

International Search Report dated Mar. 7, 2001, for application serial No. PCT/GB00/04704.

* cited by examiner

*Primary Examiner*—David Bagnell
*Assistant Examiner*—Daniel P Stephenson
(74) *Attorney, Agent, or Firm*—Patterson & Sheridan, L.L.P.

(57) ABSTRACT

A reamer shoe (1) for mounting on a tubing string has a reaming area (5) supporting a plurality of discrete reaming members (6) typically formed as simple geometrical shapes. The reaming members provide complete circumferential coverage of the shoe body (2) but the individual reaming members are non-continuous and do not fully extend either longitudinally along or circumferentially around the reaming area on the shoe body. The invention therefore provides a reamer shoe for reaming a bore in preparation for receiving casing, which is effective on rotation or reciprocation, regardless of direction or speed.

14 Claims, 1 Drawing Sheet

REAMER SHOE

BACKGROUND OF THE INVENTION (1) Field of the Invention

The present invention relates to a reamer shoe for use in drilled well bores as are typically utilised in oil and gas production.

(2) Description of Related Art

After boring a region of an oil or gas well it is normal to run tubing or "casing", into the well bore to act as a lining. The casing is typically run into the well bore from the surface and the length of casing is often referred to as a "casing string". The lining of the bore can then be strengthened by introducing cement between the external surface of the casing and the internal surface of the well bore.

It is common for the casing to meet obstructions as it is run through the well bore. These may be ledges which form in the well bore material during boring, formation washouts, or debris formed by unstable sections of the well bore wall collapsing. Such obstructions halt the progress of the casing procedure and increase the risk of the casing string jamming in the bore. To prevent or minimise the effect of these obstructions a reamer shoe is conventionally mounted on the lower end of the casing string. The reamer shoe typically has a plurality of reaming members around the circumference of the shoe body, which remove any irregularities or obstructions from the wall of the bore and thereby facilitate the subsequent passage of the casing string and aid cementing.

In conventional reamer shoes, the reaming members extend parallel to the length of the shoe. Whilst this arrangement allows the reaming members to come into contact with the entire circumference of the bore well on rotation of the shoe, complete circumferential coverage of the bore well is not achieved when the shoe is reciprocated.

An attempt has been made to mitigate this problem in International Patent Application PCT/GB99/00093 in the name Downhole Products plc. This Application discloses a reamer shoe with reaming members which extend longitudinally and helically around, as opposed to longitudinally and parallel to, the shoe body. More specifically the reaming members extend helically around the body of the shoe in an opposite direction to the intended direction of rotation.

While this arrangement of reaming members gives full 360° coverage during both reciprocating and rotation, the efficiency of said members is very much dependent on the speed and also the direction of rotation. It will be appreciated that the quality of reaming action will be compromised at relatively high rotational speeds. In addition, the reaming action of the shoe is designed to be most efficient when the reaming members extend in the opposite direction to rotation; therefore if the shoe was rotated in the same direction as the reaming members extend, either intentionally or accidentally, the risk of the reaming members "biting" into the wall and hence becoming stuck in the bore would be increased. It would therefore be a distinct advantage to provide a reamer shoe which is equally effective on rotation and reciprocation, and which provides an efficient reaming action regardless of the speed and direction of rotation.

It is an object of the present invention to provide a reamer shoe for reaming a bore in preparation for receiving casing, wherein said reaming shoe is equally effective on rotation or reciprocation.

It is a further object of the present invention to provide a reamer shoe for reaming a bore in preparation for receiving casing, wherein said reaming shoe is efficient at cleaning a bore when rotated, regardless of the speed or direction of rotation.

DETAILED DESCRIPTION OF THE INVENTION

It is a yet further object of the present invention to provide a reamer shoe for reaming a bore in preparation for receiving casing, which is effective on rotation or reciprocation, regardless of direction or speed, and which is capable of covering the full 360° circumference of the bore.

BRIEF SUMMARY OF THE INVENTION

According to the present invention there is provided a reamer shoe for mounting on a tubing string, the reamer shoe having a reaming area supporting a plurality of reaming members with each of the reaming members being afforded a simple geometric shape, wherein the plurality of reaming members have complete circumferential coverage of the shoe body but the individual reaming members are non-continuous and do not fully extend either longitudinally along or circumferentially around the reaming area on the shoe body.

Optionally the reaming members are diamond shaped.

Alternatively the reaming members are square or circular although any other simple geometrical shape may be employed.

Preferably the reaming members are shaped in such a manner that they are separated by void areas which permit the relative by pass of fluid over the reaming area, between the reaming members.

Preferably the reamer shoe has a plurality of flow by areas or flow ports to allow lubrication of the shoe.

Preferably the reaming members are made of a hard wearing and resistant material such as tungsten carbide or polycrystalline diamond, although any other suitable material may be used.

Preferably the reaming members are securely attached to the shoe body by a standard technique such as welding or mechanical locking although any other suitable fixing means could be used.

Preferably the reamer shoe has connection means for mounting the reamer shoe on a tubing string.

Most preferably said connection means are threaded end connections which can mate with corresponding connection means on the casing.

Preferably the reaming shoe has an internal diameter which is at least equal to, or greater than the internal diameter of the casing.

Preferably the reamer shoe comprises a stabiliser or centraliser.

Preferably the dimensions of the reamer shoe are not restricted and could be adapted to be suitable for use with any casing equipment.

BRIEF DESCRIPTION OF THE DRAWINGS

An example embodiment of the invention will now be illustrated with reference to FIG. 1 which illustrates a reamer shoe in accordance with the present invention.

Figure 1:
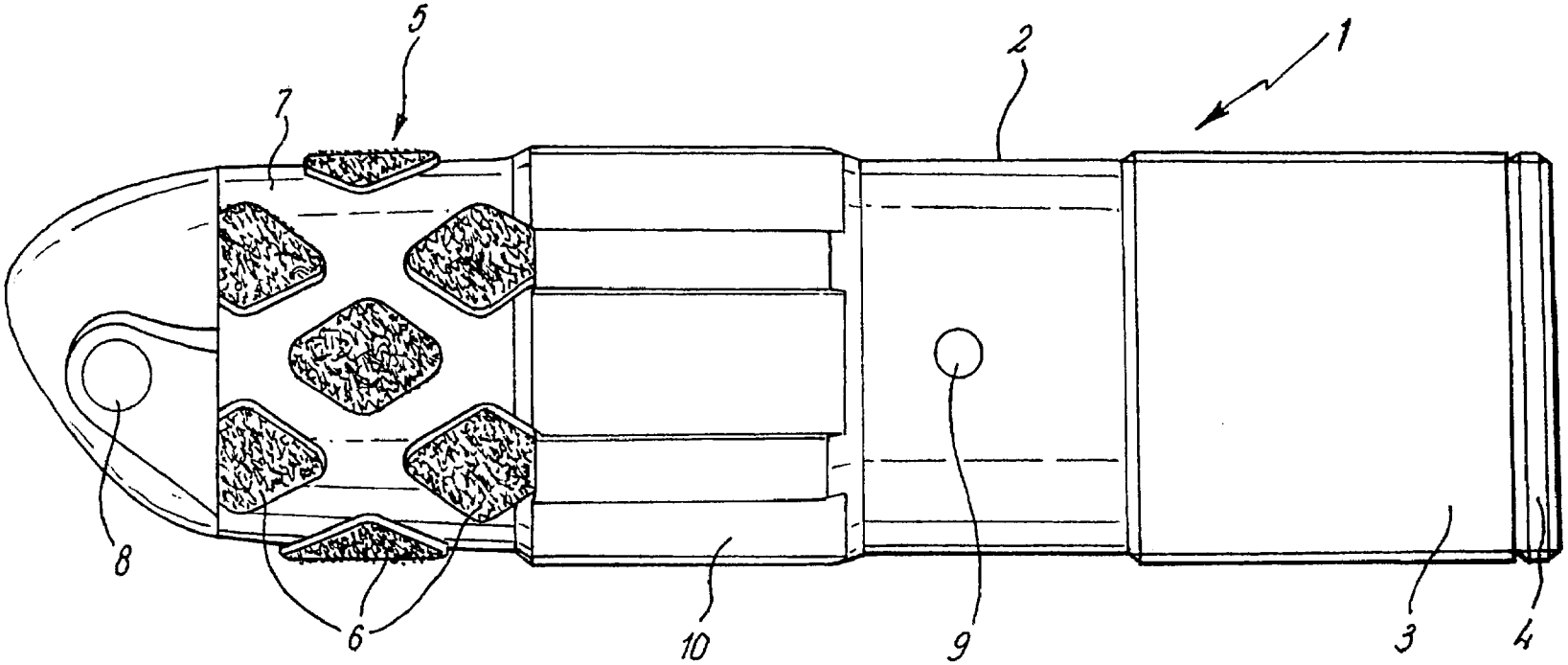
Referring to FIG. 1 a reamer shoe, generally depicted at 1, is comprised of a cylindrical body 2 which can be mounted on the lower end of a casing string (not shown). Typically mounting is achieved using threaded end connections 3 and a respective fit thread protector 4 located at the rear of the body 2 which mate with the casing.

The reamer shoe 1 further comprises a reaming area 5 which supports a plurality of reaming members 6. The reaming members 6 are constructed from a hard resistant material such as polycrystalline diamond compact or tungsten carbide, or a combination of the two materials.

The reaming members 6 do not fully extend either longitudinally along or circumferentially around the reaming area 5 on the shoe body 2 that is, they are non continuous, and are afforded a diamond shape in the present embodiment, although this is not restricted and any other geometrical shape such as circles or squares could be employed.

As the reaming members 6 are non-continuous, each individual member is separated from the surrounding reaming member by void space 7. This void space 7 functions to allow the by-pass of fluid which is passed through the bore well (not shown) over the reaming area 5. The body 2 also has an additional flow by area 8 and flow port 9 to allow fluid by pass to lubricate the surfaces of the reaming shoe 1. The body 2 also comprises a stabiliser or centraliser 10 which functions to maintain the reaming shoe 1 in the centre of the well bore (not shown).

In use, the reamer shoe 1 is mounted on the casing string (not shown) relatively close to the first section of the string. Upon reaching an obstruction or irregularity in the bore wall the tool may be reciprocated or rotated as required, in order to remove or push aside the obstruction in preparation for receiving casing. The casing operation can then be continued.

The present invention is inherent with significant advantages in that the geometrical design of the reaming members increases the efficiency of the reaming process regardless of whether the shoe is rotated or reciprocated. The tendency to "bite" into the wall of the bore and become stuck, which is often seen with conventional reaming blades which extend around the body of the shoe, is minimised.

A further advantage is that, unlike the reaming members known to the art, which conventionally extend parallel to or helically around the reamer shoe, the reaming members of the present invention are geometric and non continuous, and therefore have no direction as such. On rotation, the reaming members of the present invention are therefore effective regardless of whether the shoe is rotated in a clockwise or anti-clockwise direction.

Further modifications and improvements may be incorporated without departing from the scope of the invention herein intended.

What is claimed is:

1. A method of forming a wellbore, the method comprising:

positioning a reamer shoe in the wellbore, the reamer shoe including a reaming area having plurality of geometric non-continuous cutting members;

lubricating the reamer shoe by introducing fluid through at least one fluid port located above the reaming area and at least one fluid port located below the reaming area;

rotating the reamer shoe in a first direction; and centering the reamer shoe in the wellbore by emoloying a centralizer formed on the reamer shoe, wherein the centralizer is disposed between the reaming area and the at least one fluid port located above the reaming area.

2. The method of claim 1, wherein the plurality of reaming members are diamond shaped.

3. A reamer shoe for mounting on a tubing string, the reamer shoe comprising:

a shoe body having a bore;

a reaming area along the shoe body supporting at least one reaming member;

a plurality of flow ports disposed within the shoe body below the reaming area to provide fluid communication between the bore and the at least one reaming member and to allow lubrication of the shoe;

at least one flow part above the reaming area to further facilitate lubrication of the reamer shoe; and a centralizer disposed on the shoe body, wherein the centralizer is disposed between the reaming area and the at least one fluid port located above the reaming area.

4. The reamer shoe of claim 3, wherein the at least one reaming member provides complete circumferential coverage of the shoe body.

5. The reamer shoe of claim 4, wherein each reaming member is non-continuous and does not fully extend either longitudinally along or circumferentially around the reaming area on the shoe body.

6. The reamer shoe of claim 3, wherein the at least one reaming member is arranged to ream in an equally effective manner whether the tubing string is rotated in a clockwise direction, rotated in an anti-clockwise direction, or axially reciprocated.

7. The reamer shoe of claim 3, wherein the at least one reaming member is diamond shaped.

8. The reamer shoe of claim 3, wherein the at least one reaming member is formed as a discrete geometrical shape.

9. The reamer shoe of claim 3, wherein each reaming member is separated by a void area to permit a by-pass of fluid therebetween.

10. The reamer shoe of claim 3, wherein the at least one reaming member is at least partially fabricated from a hard material selected from the group consisting of tungsten carbide, polycrystalline diamond, and combinations thereof.

11. The reamer shoe of claim 3, wherein the at least one reaming member is welded to the shoe body.

12. The reamer shoe of claim 3, wherein the at least one reaming member is mechanically locked to the shoe body.

13. The reamer shoe of claim 3, further comprising a threaded end for mounting the reamer shoe on the tubing string.

14. The reamer shoe of claim 3, wherein the bore has an internal diameter which is at least equal to or greater than an internal diameter of the tubing string.

* * * * *

UNITED STATES PATENT AND TRADEMARK OFFICE

CERTIFICATE OF CORRECTION

PATENT NO. : 6,983,811 B2
APPLICATION NO. : 10/149096
DATED : January 10, 2006
INVENTOR(S) : Mike Wardley It is certified that error appears in the above-identified patent and that said Letters Patent is hereby corrected as shown below:

In column 4, Claim 3, lines 12 and 13, please delete “at least one reaming member” and insert --a plurality of reaming members--.

In column 4, Claim 3, line 16, please delete “at least one reaming member” and insert --reaming members--.

In column 4, Claim 3, line 18, please delete “part” and insert --port--.

In column 4, Claim 4, lines 24 and 25, please delete “at least one reaming member provides” and insert --reaming members provide--.

In column 4, Claim 6, lines 31 and 32, please delete “at least one reaming member is” and insert --reaming members are--.

In column 4, Claim 7, lines 36 and 37, please delete “at least one reaming member is” and insert --reaming members are--.

In column 4, Claim 8, lines 38 and 39, please delete “at least one reaming member is” and insert --reaming members are--.

In column 4, Claim 10, lines 43 and 44, please delete “at least one reaming member is” and insert --reaming members are--.

In column 4, Claim 11, lines 47 and 48, please delete “at least one reaming member is” and insert --reaming members are--.

UNITED STATES PATENT AND TRADEMARK OFFICE

CERTIFICATE OF CORRECTION

PATENT NO. : 6,983,811 B2
APPLICATION NO. : 10/149096
DATED : January 10, 2006
INVENTOR(S) : Mike Wardley It is certified that error appears in the above-identified patent and that said Letters Patent is hereby corrected as shown below:

In column 4, Claim 12, lines 49 and 50, please delete "at least one reaming member is" and insert --reaming members are--.

Signed and Sealed this

Twenty-second Day of May, 2007

JON W. DUDAS
*Director of the United States Patent and Trademark Office*